US008443932B2

(12) United States Patent
Miyahara et al.

(10) Patent No.: US 8,443,932 B2
(45) Date of Patent: May 21, 2013

(54) WORKING MACHINE

(75) Inventors: Yasuhiro Miyahara, Tsuchiura (JP); Junya Kawamoto, Tsuchiura (JP); Yuuki Umizaki, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 13/228,004

(22) Filed: Sep. 8, 2011

(65) Prior Publication Data

US 2012/0061177 A1 Mar. 15, 2012

(30) Foreign Application Priority Data

Sep. 10, 2010 (JP) ..... 2010-203461

(51) Int. Cl.
*F01N 13/08* (2010.01)

(52) U.S. Cl.
USPC ..... 181/228; 181/212; 181/227; 181/296

(58) Field of Classification Search
USPC ..... 181/212, 227, 228; 180/296
See application file for complete search history.

(56) References Cited

U.S. PATENT DOCUMENTS 2,242,494 A * 5/1941 Wolf ..... 180/68.1
2,850,314 A * 9/1958 Haigh et al. ..... 293/113
3,792,722 A * 2/1974 Harmon ..... 138/108
4,388,804 A * 6/1983 Bushmeyer ..... 60/319
6,220,387 B1 * 4/2001 Hoppes et al. ..... 181/259
7,779,961 B2 * 8/2010 Matte ..... 181/227
7,891,452 B2 * 2/2011 Iwamoto et al. ..... 180/89.2
7,958,966 B2 * 6/2011 Smith ..... 181/264
7,971,432 B2 * 7/2011 Troxler ..... 60/324
2010/0126791 A1 * 5/2010 Okada ..... 180/296
2011/0005853 A1 * 1/2011 Kamiya ..... 180/296

FOREIGN PATENT DOCUMENTS

JP 2002-70077 A 3/2002

* cited by examiner

*Primary Examiner* — Forrest M Phillips
(74) *Attorney, Agent, or Firm* — Crowell & Moring LLP

(57) ABSTRACT

A working machine is provided with a revolving upperstructure, working equipment, an engine compartment, a counterweight, a muffler, and an exhaust path for releasing exhaust gas, which has been discharged from the muffler, to an outer side of the revolving upperstructure. The exhaust path includes a tailpipe connected to the muffler and an exhaust pipe for releasing exhaust gas, which has been discharged from the tailpipe, to the outer side of the revolving upperstructure. The counterweight is utilized for the formation of the exhaust path. The exhaust path includes a passage formed in the counterweight and accommodating an upper end portion of the tailpipe inserted therein with a predetermined clearance formed around the upper end portion such that the exhaust gas discharged from the tailpipe can be guided to the exhaust pipe.

12 Claims, 8 Drawing Sheets

WORKING MACHINE

CROSS-REFERENCE TO RELATED APPLICATION

This application claims the priority of Japanese Patent Application 2010-203461 filed Sep. 10, 2010, which is incorporated herein by reference.

BACKGROUND OF THE INVENTION

1. Field of the Invention

The present invention relates to a working machine such as a compact excavator, which is provided with an exhaust path for releasing exhaust gas, which has been discharged from a muffler, to an outer side of a revolving upperstructure and makes use of a counterweight for the formation of the exhaust path.

2. Description of the Related Art

As a conventional technology of this kind, there is the technology disclosed in JP-A-2002-70077. This conventional technology is applied to a hydraulic excavator provided with a travel base, a revolving upperstructure mounted on the travel base, and working equipment attached pivotally in up and down directions to the revolving upperstructure and including a boom, an arm, and a bucket or the like. In this hydraulic excavator, an exhaust gas silencer for silencing exhaust gas discharged from an engine, that is, a muffler is accommodated in a recess formed in a counterweight. An exhaust pipe connected to the muffler, specifically a tailpipe is formed of a straight pipe extending in a vertical direction. An upper end portion of the tailpipe is inserted with a predetermined clearance in a guide pipe, in other words, an exhaust pipe that releases exhaust gas, which has been discharged from the tailpipe, to an outer side of the revolving upperstructure. The exhaust pipe in which the upper end portion of the tailpipe is inserted is provided in a vicinity of a lower end thereof with a flange, and this flange is fixed by bolts on a cover plate fixedly secured on the counterweight such that the above-mentioned recess of the counterweight is covered up. Exhaust gas from the engine is guided via the muffler and tailpipe into the exhaust pipe in which the tailpipe is inserted, and is then released from the exhaust pipe to an outer side of the revolving upperstructure.

According to the above-described conventional technology, intense heat of exhaust gas is transferred to the counterweight via the exhaust pipe in which the upper end portion of the tailpipe is inserted and also via the cover plate on which the exhaust pipe is fixed. The conventional technology, therefore, contributes to lowering the temperature of exhaust gas which is to be released to the outer side of the revolving upper structure. However, the conventional technology involves a problem in that sufficient heat transfer effect can be hardly obtained by the counterweight because the intense heat of the exhaust gas is conducted to the counterweight by way of the exhaust pipe and cover plate.

In this conventional technology, the intense heat of the exhaust gas guided to the exhaust pipe via the tailpipe is conducted to the cover plate that holds the exhaust pipe in place, and the thickness dimension of the cover plate is set small. There is, accordingly, a potential problem that the cover plate may undergo a deflection under the intense heat. If such a deflection occurs, a problem may arise in that the exhaust pipe held in place by the cover plate may lean to change the releasing direction of exhaust gas.

SUMMARY OF THE INVENTION

With the above-described circumstances of the conventional technology in view, the present invention has as an object thereof the provision of a working machine which can more efficiently lower the temperature of exhaust gas to be released from an exhaust pipe to an outside of a revolving upperstructure.

To achieve the above-described object, the present invention provides, in one aspect thereof, a working machine provided with a revolving upperstructure, working equipment attached to the revolving upperstructure, an engine compartment arranged on the revolving upperstructure, a counterweight disposed behind the engine compartment, a muffler for silencing exhaust gas discharged from an engine accommodated in the engine compartment, and an exhaust path for releasing exhaust gas, which has been discharged from the muffler, to an outer side of the revolving upperstructure, said exhaust path including a tailpipe connected to the muffler and an exhaust pipe for releasing exhaust gas, which has been discharged from the tailpipe, to the outer side of the revolving upperstructure, and said counterweight being utilized for the formation of the exhaust path, wherein the exhaust path comprises a passage formed in the counterweight and accommodating an upper end portion of the tailpipe inserted therein with a predetermined clearance formed around the upper end portion such that the exhaust gas discharged from the tailpipe can be guided to the exhaust pipe.

According to the present invention constructed as described above, the exhaust gas from the engine passes through the passage formed in the counterweight while being guided to the exhaust pipe via the muffler and tailpipe. In this passage, intense heat of the exhaust gas can thus be transferred to the counterweight. As a result, the temperature of the exhaust gas to be released from the exhaust pipe to the outside of the revolving upperstructure can be lowered more efficiently.

Preferably, the passage formed in the counterweight may comprise a restricted passage having a diameter dimension that progressively decreases toward an upper end thereof; and the exhaust pipe may have a flange for securing the exhaust pipe on an upper surface of the counterweight such that the restricted passage is maintained in communication with the exhaust pipe.

According to the present invention constructed as described immediately above, in the restricted passage formed in the counterweight, the intense heat of the exhaust gas guided to the restricted passage can be transferred to the counterweight, and owing to this restricted passage, the flow rate of the exhaust gas is increased so that the exhaust gas can be vigorously released from the exhaust pipe. As the flange of the exhaust pipe is secured on the upper surface of the counterweight, the intense heat of the exhaust gas that passes through the exhaust pipe can be conducted to the counterweight via the flange. By this conduction, the temperature of the exhaust gas can be also lowered. Further, the exhaust pipe can be always maintained in a stable upright position, because the exhaust pipe is held via the flange on the counterweight which has a thickness sufficient to form the restricted passage and is at low risk of thermal deformation.

Preferably, the tailpipe may comprise a straight pipe extending in a vertical direction, and the restricted passage may have a vertical cross-section in a trapezoidal shape formed by vertically cutting a truncated circular cone.

According to the present invention constructed as described immediately above, the tailpipe and the restricted passage formed in the counterweight can be formed in relatively simple shapes.

Preferably, the tailpipe may comprise a vertical section connected to the muffler and extending in a vertical direction, and an inclined section arranged in conjunction with the vertical section, progressively extending rearward toward an upper end thereof and having an upper end portion inserted in the restricted passage formed in the counterweight; and the restricted passage may comprise an inclined path having an inclination such that the restricted passage progressively extends rearward toward an upper end thereof.

According to the present invention constructed as described immediately above, the angle between the vertical section and inclined section of the tailpipe and the length dimensions of the vertical section and inclined section can be set depending on the layout and position of the muffler.

Preferably, the working machine may be further provided with an exhaust-pipe holding member fixed on the counterweight and holding the exhaust pipe in place; the passage formed in the counterweight may comprise an exhaust passage set at a same diameter dimension over an entire length thereof; the exhaust-pipe holding member may be provided with a restricted passage communicating to the exhaust passage and having a diameter dimension that progressively decreases toward an upper end thereof; and the exhaust pipe may have a flange for securing the exhaust pipe on an upper surface of the exhaust-pipe holding member such that the restricted passage of the exhaust-pipe holding member is maintained in communication with the exhaust pipe.

According to the present invention constructed as described immediately above, at the exhaust passage formed in the counterweight, the intense heat of the exhaust gas can be transferred to the counterweight, whereby the temperature of the exhaust gas can be lowered. Further, heat can also be transferred to the counterweight via the restricted passage of the exhaust-pipe holding member arranged integrally with the counterweight, and through this restricted passage of the exhaust-pipe holding member, the flow rate of the exhaust gas is increased so that the exhaust gas can be vigorously released from the exhaust pipe. The heat of the exhaust gas, which has been conducted from the flange of the exhaust pipe, can also be transferred to the counterweight. Further, the fabrication of the counterweight is easy as the exhaust passage formed in the counterweight is set at the same diameter dimension over the entire length thereof. Furthermore, the exhaust pipe can be always maintained in a stable upright position, because the exhaust pipe is held via the flange on the counterweight which has a thickness sufficient to form the restricted passage and is at low risk of thermal deformation.

As the exhaust path for releasing exhaust gas, which has been discharged from the muffler, to the outer side of the revolving upperstructure includes the passage formed in the counterweight and accommodating the upper end portion of the tailpipe inserted therein with the predetermined clearance formed around the upper end portion such that the exhaust gas discharged from the tailpipe can be guided to the exhaust pipe. At this passage, the intense heat of the exhaust gas can thus be transferred to the counterweight so that the temperature of the exhaust gas can be lowered more efficiently. Compared with before, it is hence possible to lessen the adverse effects which the heat of exhaust gas released to the outer side of the revolving upperstructure gives to the surrounding environment.

DETAILED DESCRIPTION OF PREFERRED EMBODIMENTS

The embodiments of the working machine according to the present invention will hereinafter be described with reference to the accompanying drawings.

Figure 1:
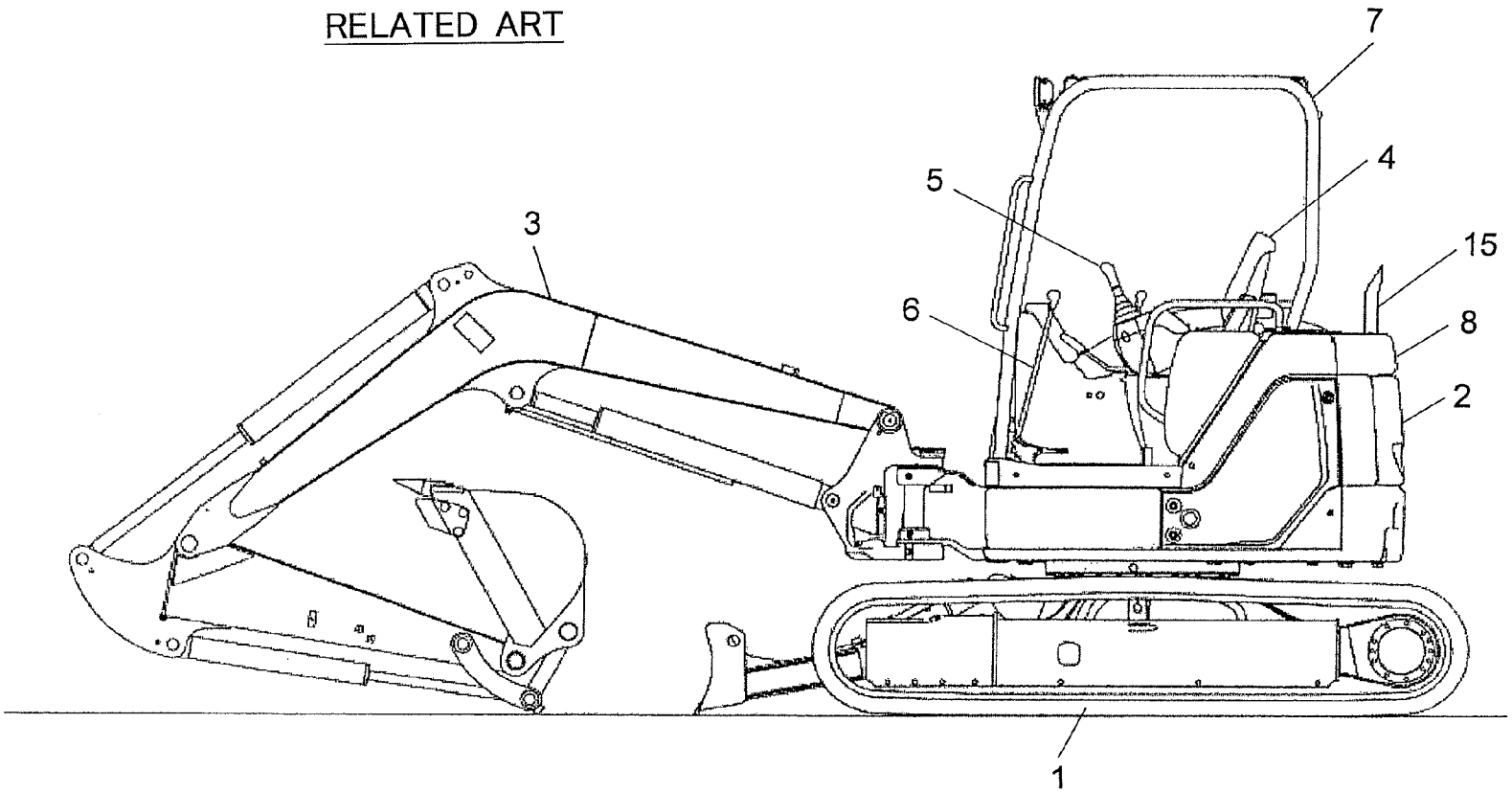
RELATED ART FIG. 1
FIG. 1 is a side view of a compact excavator as one example of a working machine to which the present invention can be applied.
Figure 2:
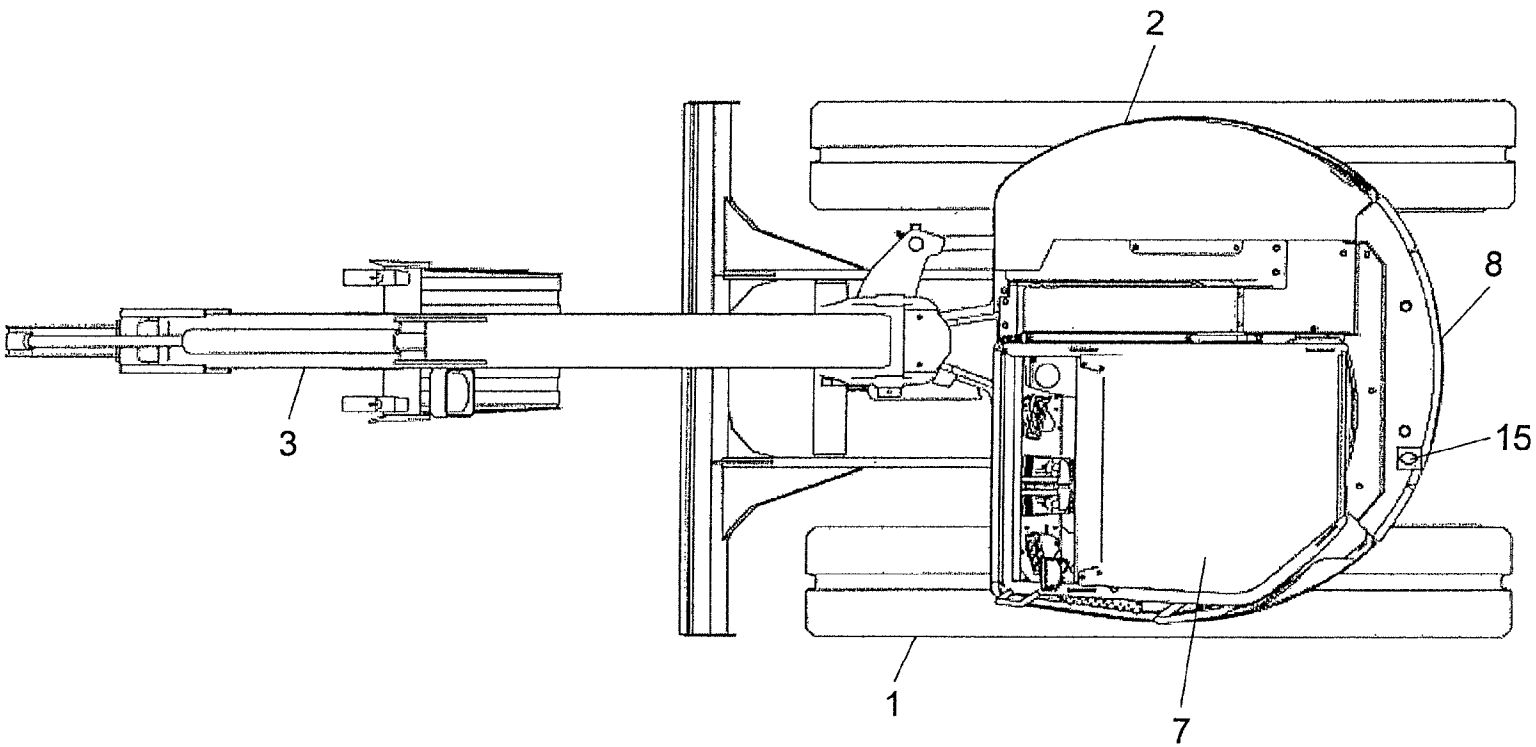
RELATED ART FIG.2
FIG. 2 is a plan view of the compact excavator.
Figure 3:
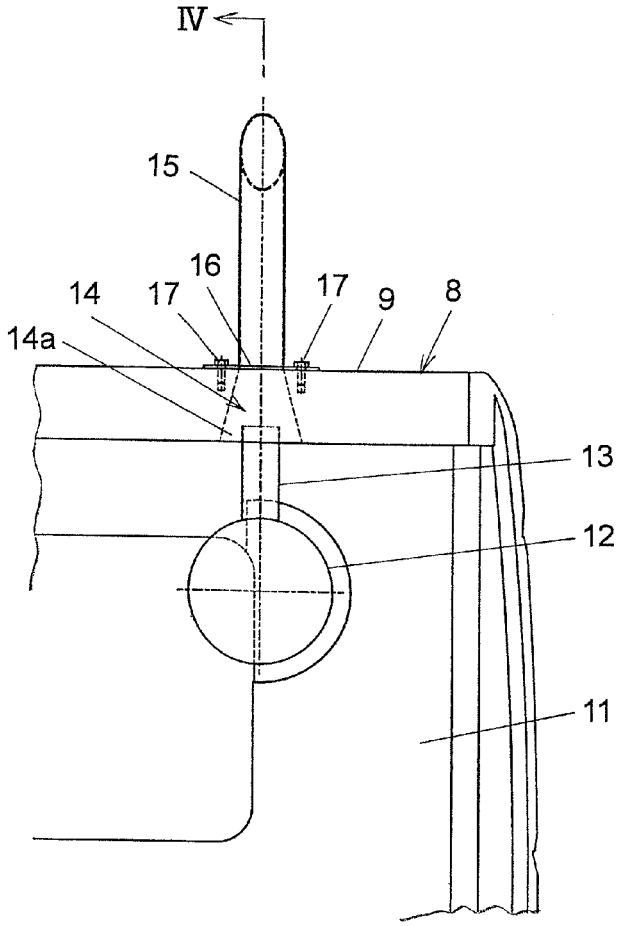
FIG. 3 is a fragmentary front view of a counterweight disposed on a compact excavator according to a first embodiment of the present invention and its associated members as viewed from a side of an engine compartment.
Figure 4:
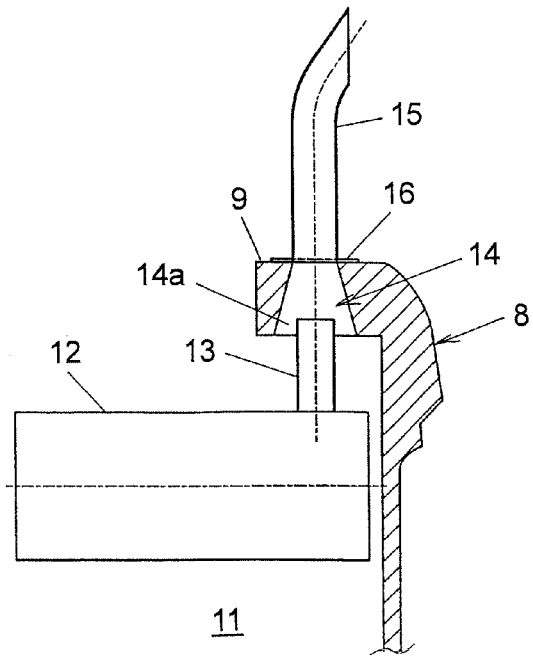
FIG. 4 is a cross-sectional view taken in the direction of arrow IV of FIG. 3.
Figure 5:
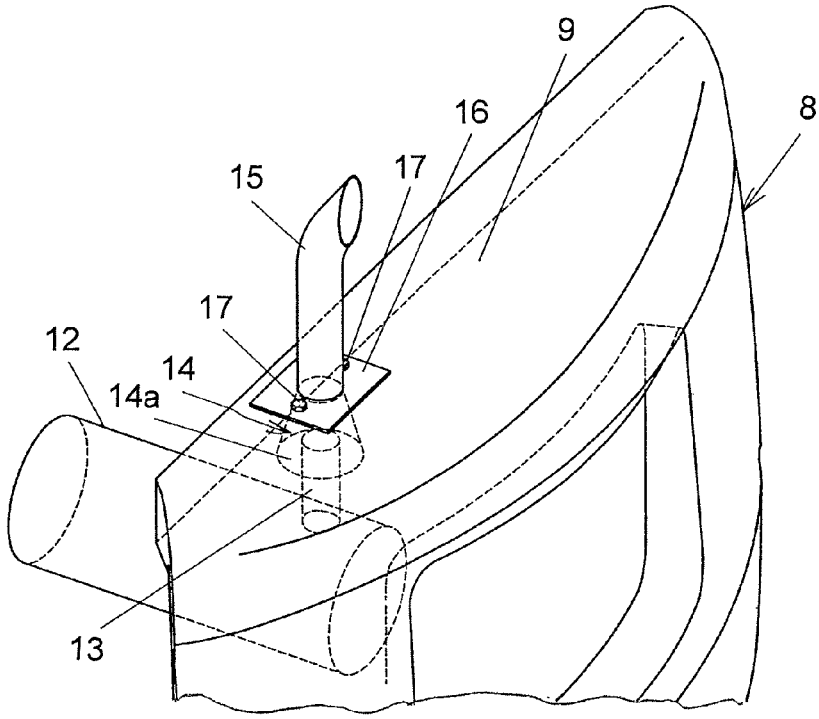
FIG. 5 is a fragmentary perspective view of the counterweight disposed on the compact excavator according to the first embodiment and its associated members as viewed from a side of a rear wall of the counterweight.
Figure 6:
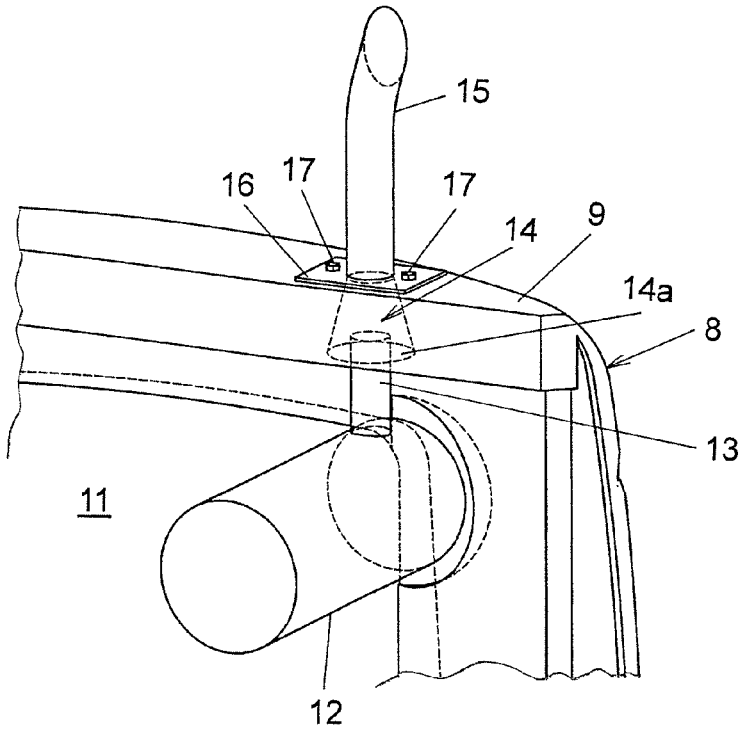
FIG. 6 is a fragmentary perspective view of the counterweight disposed on the compact excavator according to the first embodiment and its associated members as viewed from the side of the engine compartment.

Referring first to FIGS. 1 and 2, the working machine to which the present invention can be applied is, for example, a compact excavator as a small machine. This compact excavator is provided with a travel base 1, a revolving upperstructure mounted on the travel base 1, and working equipment 3 attached pivotally in up and down directions to the revolving upperstructure 2 and including a boom, an arm, and a bucket or the like to perform digging work of earth or sand or like work. On the revolving upperstructure 2, a seat 4 is arranged. Laterally to the seat 4, control devices 5 are arranged to operate the working equipment 3 and revolving upperstructure 2, respectively. In front of the seat 4, a travel lever 6 is arranged to operate the travel base 1. A space above the seat 4 is covered by a canopy 7. Behind the seat 4, a cast counterweight 8 is disposed to assure a static balance. Between the seat 4 and the counterweight 2, an engine compartment is arranged to accommodate an engine, hydraulic pumps and the like none of which are shown in the drawings.

With reference to FIGS. 3 through 6, a description will next be made of a compact excavator as the first embodiment of the working machine according to the present invention. The compact excavator as the first embodiment is provided with a muffler 12 for silencing exhaust gas discharged from the unillustrated engine accommodated in the engine compartment 11. This compact excavator is also provided with an exhaust path for releasing exhaust gas, which has been discharged from the muffler 12, to an outer side of the revolving upperstructure 2. This exhaust path includes a tailpipe 13 connected to the muffler 12 and an exhaust pipe 15 for releasing exhaust gas, which has been discharged from the tailpipe 13, to the outer side of the revolving upperstructure 2.

The exhaust path also includes a passage 14 formed in an upper part of the counterweight 8 and accommodating an upper end portion of the tailpipe 13 inserted therein with a predetermined clearance 14*a* formed around the upper end portion such that the exhaust gas discharged from the tailpipe 13 can be guided to the exhaust pipe 15, for example, a restricted passage 14 having a diameter dimension that progressively decreases toward an upper end thereof.

The exhaust pipe 15 has a flange 16 for securing the exhaust pipe 15 on an upper surface 9 of the counterweight 8 such that the restricted passage 14 is maintained in communication with the exhaust pipe 15. The flange 16 of the exhaust pipe 15 is formed, for example, in a rectangular shape, and is fixed by plural bolts 17 on the upper surface 9 of the counterweight 8.

The tailpipe 13 is formed, for example, of a straight pipe extending in a vertical direction. The restricted passage 14 of the counterweight 8 has a vertical cross-section, for example, in a trapezoidal shape formed by vertically cutting a truncated circular cone.

According to the compact excavator as the first embodiment, the exhaust gas from the engine is silenced in the muffler 12, is guided to the restricted passage 14 of the counterweight 8 from the tailpipe 13 connected to the muffler 12, is guided further to the exhaust pipe 15, and is then released to the outer side of the revolving upperstructure 2.

Along the muffler 12 and the exhaust path, vibrations of a vibration system, which includes the muffler 12 arranged integrally with the unillustrated engine and the tailpipe 13, and those of another vibration system, which includes the counterweight 8 and exhaust pipe 15, are allowed in the clearance 14*a* between the tailpipe 13 and the restricted passage 14 of the counterweight 8, and therefore, these vibration systems can be maintained independent from each other without restraining each other. Owing to this feature, vibrations of the another vibration system including the counterweight 8 and exhaust pipe 15 are not transmitted to mounting parts for the unillustrated engine and the muffler 12 so that the mounting parts for these unillustrated engine and muffler 12 can be protected.

When the exhaust gas is guided from the tailpipe 13 to the restricted passage 14 of the counterweight 8, an air stream around the tailpipe 13 is drawn into the restricted passage 14 through the clearance 14*a*. By this air stream, the intense heat of the exhaust gas is cooled.

According to the compact excavator constructed as the first embodiment as described above, the exhaust gas from the unillustrated engine passes through the restricted passage 14 formed in the counterweight 8 while being guided to the exhaust pipe 15 via the muffler 12 and tailpipe 13. At this restricted passage, the intense heat of the exhaust gas can hence be transferred to the counterweight 8. As a consequence, the temperature of exhaust gas to be released from the exhaust pipe 15 to the outer side of the revolving upperstructure 2 can be lowered more efficiently.

As the flange 16 of the exhaust pipe 15 is secured on the upper surface 9 of the counterweight 8, the heat of the exhaust gas that passes through the exhaust pipe 15 can be conducted to the counterweight 8 via the flange 16. These transfer and conduction of heat can lessen the adverse effects which the heat of exhaust gas released to the outer side of the revolving upperstructure gives to the surrounding environment.

Owing to the restricted passage 14 formed in the counterweight 8, the flow rate of the exhaust gas is increased so that the exhaust gas can be vigorously released from the exhaust pipe 15. As a consequence, excellent releasing performance can be assured for exhaust gas.

Further, the exhaust pipe 15 can be always maintained in a stable upright position, because the exhaust pipe 15 is held via the flange 16 on the counterweight 8 which has a thickness sufficient to form the restricted passage 14 and is at low risk of thermal deformation. As a consequence, a highly-reliable holding structure has been realized for the exhaust pipe 15. As the exhaust pipe 15 can be stably held, the length dimension of the exhaust pipe 15 can be increased to realize an enlargement of the exhaust pipe 15. For the compact excavator that the position of an exhaust-gas release port of the exhaust pipe 15 tends to be located close to the ground plane, it is especially effective to increase the length dimension of the exhaust pipe 15 as described above. When designed to release exhaust gas at as high a position as possible, it is possible to realize the protection of plants of relatively low height, which are planted around the compact excavator, from the intense heat of exhaust gas.

According to this first embodiment, the tailpipe 13 and the restricted passage 14 formed in the counterweight 8 can be formed in relatively simple shapes. Accordingly, the first embodiment is easy to manufacture, and has high practical utility.

Figure 7:
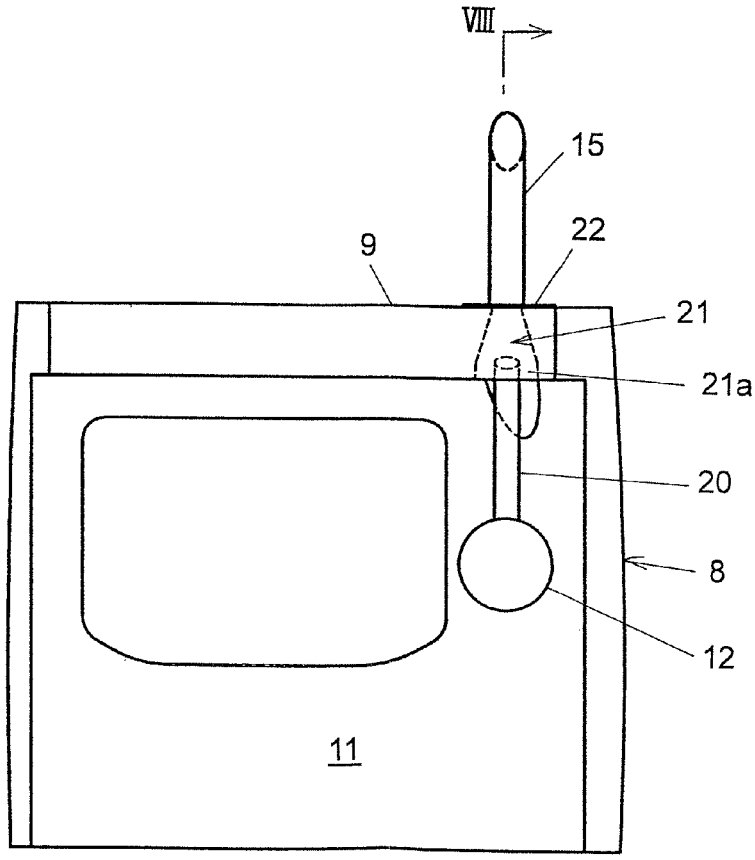
FIG. 7 is a fragmentary front view of a counterweight disposed on a compact excavator according to a second embodiment of the present invention and its associated members as viewed from a side of an engine compartment.
Figure 8:
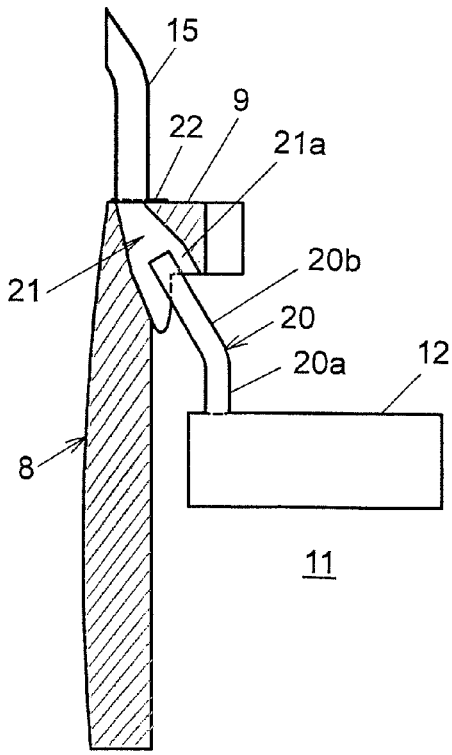
FIG. 8 is a cross-sectional view taken in the direction of arrow VIII of FIG. 7.
Figure 9:
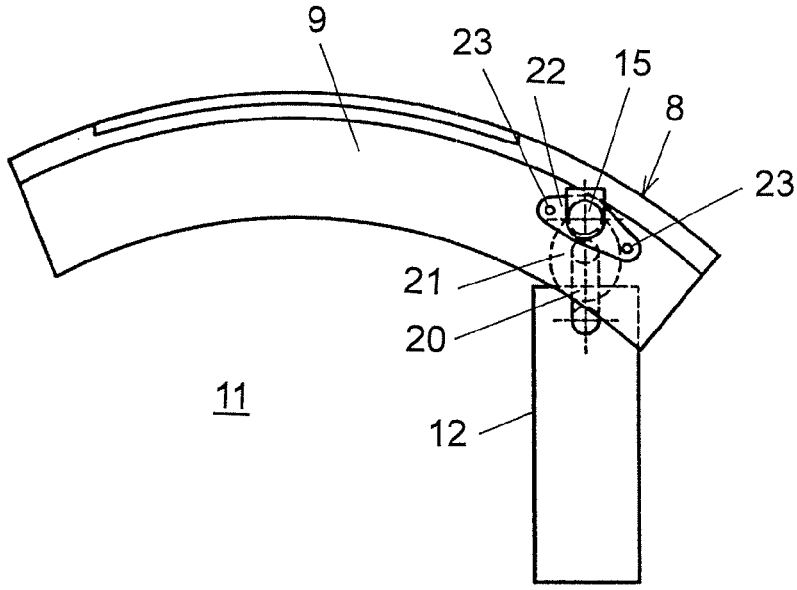
FIG. 9 is a plan view of FIG. 7.
Figure 10:
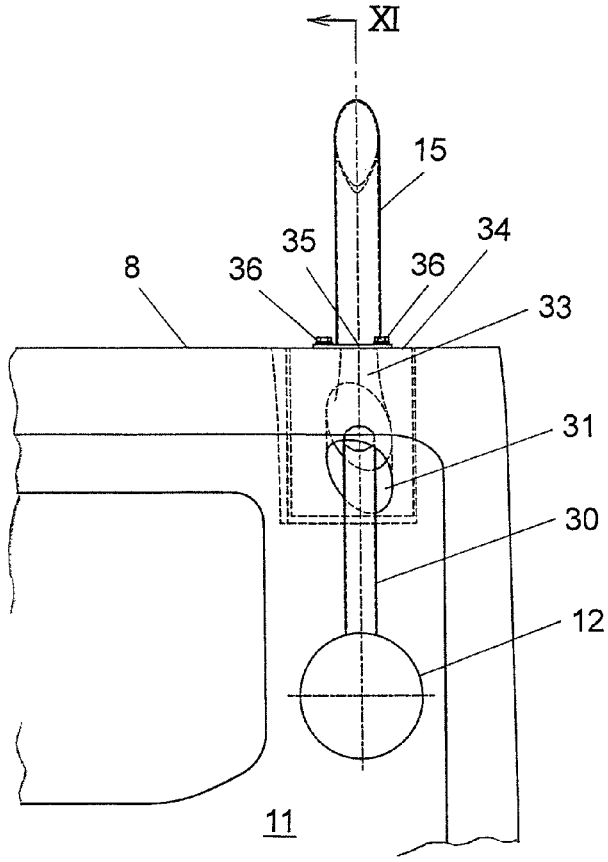
FIG. 10 is a fragmentary front view of a counterweight disposed on a compact excavator according to a third embodiment of the present invention and its associated members as viewed from a side of an engine compartment.
Figure 11:
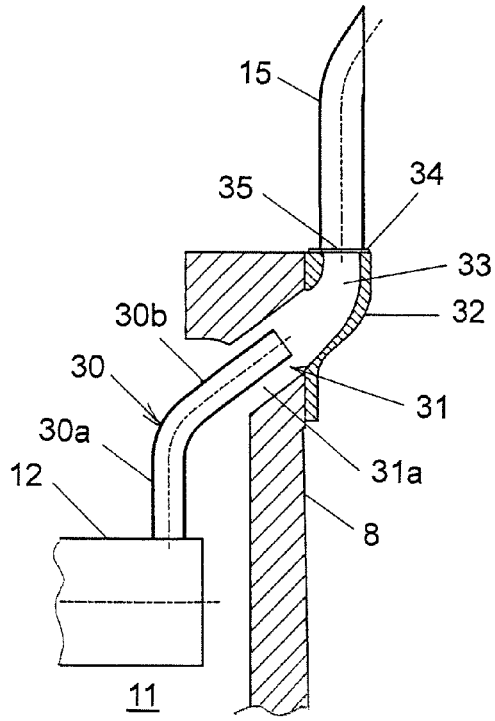
FIG. 11 is a cross-sectional view taken in the direction of arrow XI of FIG. 10.

Referring next to FIGS. 7 through 9, a compact excavator as a second embodiment of the present invention will be described hereinafter.

The working machine according to this second embodiment is also a similar compact excavator as in the above-described first embodiment. In the compact excavator as the second embodiment, a tailpipe 20 connected to the muffler 12 is formed of a vertical section 20*a* and an inclined section 20*b*. The vertical section 20*a* is connected to the muffler 12 and extends in a vertical direction. The inclined section 20*b* is arranged in conjunction with the vertical section 20*a*, progressively extends rearward toward an upper end thereof, and has an upper end portion inserted in a restricted passage 21 formed in the counterweight 8.

In this restricted passage 21, the upper end portion 20*b* of the tailpipe 20 is inserted with a predetermined clearance 21*a* formed around the upper end portion such that the exhaust gas discharged from the tailpipe 20 can be guided to the exhaust pipe 15. As depicted in FIG. 8, the restricted passage 21 is formed of an inclined path having an inclination such that the inclined path progressively extends rearward toward an upper end thereof. As illustrated in FIG. 9, a flange 22 of the exhaust pipe 15 is formed, for example, in a substantially oval shape in view of the shape of an upper edge portion of the counterweight 8. The flange 22 is fixed by bolts 23 on the upper surface 9 of the counterweight 8 to hold the exhaust pipe 15 on the counterweight 8. The remaining construction is equal to the corresponding construction in the above-described first embodiment.

In this compact excavator as the second embodiment, the counterweight 8 is also provided with the restricted passage 21 in which the upper end portion of the inclined section 20*b* of the tailpipe 20 is inserted. Similar to the above-described first embodiment, the intense heat of exhaust gas can therefore be transferred to the counterweight 8 at the restricted passage 21. Further, the flange 22 of the exhaust pipe 15 is fixed on the upper surface 9 of the counterweight 8 so that the heat of exhaust gas guided to the exhaust pipe 15 can be transferred to the counterweight 8 via the flange 22. The second embodiment can, therefore, bring about similar advantageous effects as the first embodiment.

Owing to the restricted passage 21 formed in the counterweight 8, excellent releasing performance can be obtained for exhaust gas as in the first embodiment.

Further, the exhaust pipe 15 can be always maintained in a stable upright position on the upper surface 9 of the counterweight 8 via the flange 22. In this respect too, the second embodiment can bring about similar advantageous effects as the first embodiment.

In the compact excavator as the second embodiment, the angle between the vertical section 20*a* and inclined section 20*b* of the tailpipe 20 and the length dimensions of the vertical section 20*a* and inclined section 20*b* can be set depending on the layout and position of the muffler 12. A higher degree of freedom or tolerance can, therefore, be enjoyed as to the layout designing of the muffler 12.

With reference to FIGS. 10 through 13, a description will next be made of a compact excavator as a third embodiment of the present invention.

The working machine according to this third embodiment is also a similar compact excavator as in the above-described first embodiment. The compact excavator as the third embodiment is provided with an exhaust-pipe holding member 32 which is fixed on the counterweight 8 and holds the exhaust pipe 15 in place. This exhaust-pipe holding member 32 is made of a similar cast iron as the counterweight 8. Similar to the second embodiment, a tailpipe 30 connected to the muffler 12 is formed of a vertical section 30*a* connected to the muffler 12 and an inclined section 30*b* arranged in conjunction with the vertical section 30*a*. Further, an exhaust passage 31 is formed in the counterweight 8. In this exhaust passage 31, an upper end portion of the inclined section 30*b* of the tailpipe 30 is inserted with a predetermined clearance 31*a* such that the exhaust gas discharged from the tailpipe 30 can be guided to the exhaust pipe 15. This exhaust passage 31 is set at the same diameter dimension along the entire length thereof.

Figure 12:
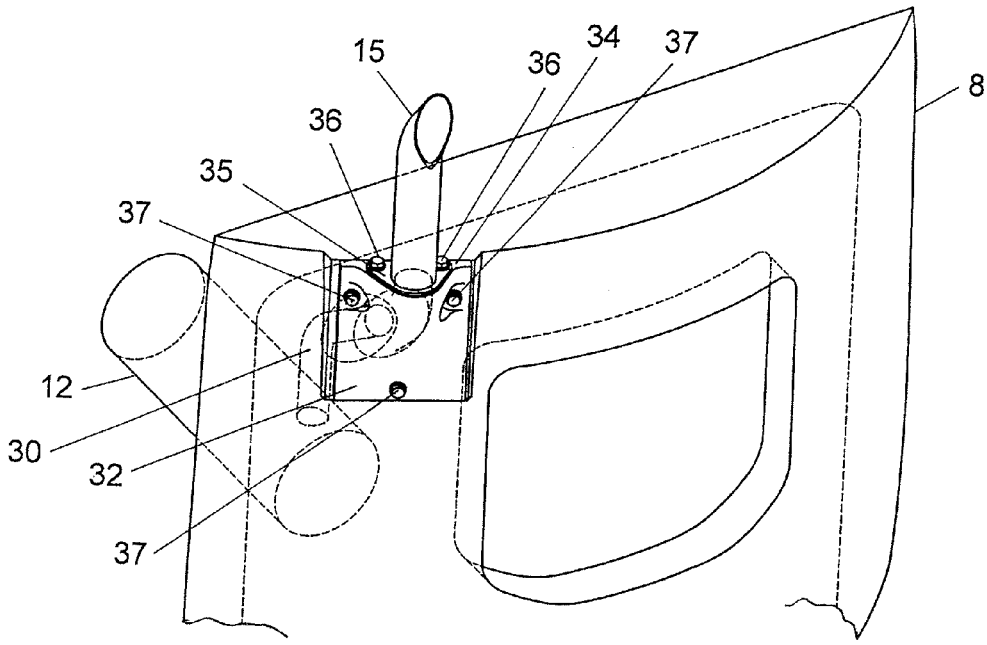
FIG. 12 is a fragmentary perspective view of the counterweight disposed on the compact excavator according to the third embodiment and its associated members as viewed from a side of a rear wall of the counterweight.
Figure 13:
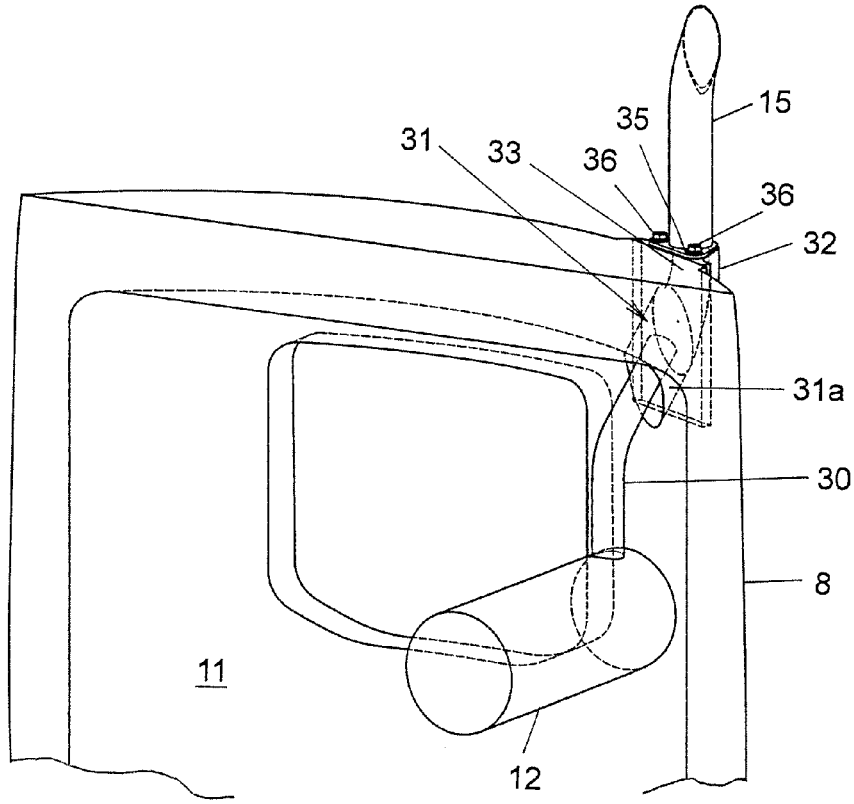
FIG. 13 is a fragmentary perspective view of the counterweight disposed on the compact excavator according to the third embodiment and its associated members as viewed from the side of the engine compartment.

The exhaust-pipe holding member 32 is provided with a restricted passage 33 formed such that the restricted passage 33 is maintained in communication with the exhaust passage 31 and has a diameter dimension progressively decreasing toward an upper end thereof. Further, the exhaust pipe 15 has a flange 35 via which the exhaust pipe 15 is fixed on an upper surface 34 of the exhaust-pipe holding member 32 such that the restricted passage 33 of the exhaust-pipe holding member 32 is maintained in communication with the exhaust pipe 15. This flange 35 is fixed by plural bolts 36 on the upper surface 34 of the exhaust-pipe holding member 32. As depicted in FIG. 12, the exhaust-pipe holding member 32 is fixed by plural bolts 37 on an upper part of a rear wall of the counterweight 8. The remaining construction is equal to the corresponding construction in the above-described first embodiment.

In this compact excavator as the third embodiment, the counterweight 8 is also provided with the exhaust passage 31 in which the upper end portion of the inclined section 30*b* of the tailpipe 30 is inserted. Similar to the above-described first embodiment, the intense heat of exhaust gas can therefore be transferred at the exhaust passage 31 to the counterweight 8 via the exhaust-pipe holding member 32. Further, the heat of exhaust gas guided to the exhaust pipe 15 can be transferred to the counterweight 8 via the flange 35 of the exhaust pipe 15 and the exhaust-pipe holding member 32. The second embodiment can, therefore, bring about similar advantageous effects as the first embodiment.

Owing to the restricted passage 33 formed in the exhaust-pipe holding member 32, excellent releasing performance can be obtained for exhaust gas as in the first embodiment.

The angle between the vertical section 30*a* and inclined section 30*b* of the tailpipe 30 and the length dimensions of the vertical section 30*a* and inclined section 30*b* can be set depending on the layout and position of the muffler 12. Similar to the second embodiment, a higher degree of freedom or tolerance can, therefore, be enjoyed as to the layout designing of the muffler 12.

The exhaust passage 31 formed in the counterweight 8 is set at the same diameter dimension over the entire length thereof. Therefore, the manufacture of the counterweight 8 is easy, and the manufacturing cost of the counterweight 8 can be limited low.

Further, the exhaust pipe 15 can be always maintained in a stable upright position, because the exhaust pipe 15 is held via the flange 35 on the exhaust-pipe holding member 32 which has a thickness sufficient to form the restricted passage 33 and is at low risk of thermal deformation. In this respect too, the second embodiment can bring about similar advantageous effects as the first embodiment.

It is to be noted that despite the formation of the exhaust passage 31 in the counterweight 8, this third embodiment is effective especially in the case of a small compact excavator in which the thickness dimension of the counterweight 8 has to be set relatively small or a small compact excavator in which a layout space can be hardly found for the exhaust pipe 15 on the upper surface of the counterweight 8.

The invention claimed is:

1. A working machine provided with a revolving upperstructure, working equipment attached to the revolving upperstructure, an engine compartment arranged on the revolving upperstructure, a counterweight disposed behind the engine compartment, a muffler for silencing exhaust gas discharged from an engine accommodated in the engine compartment, and an exhaust path for releasing exhaust gas, which has been discharged from the muffler, to an outer side of the revolving upperstructure, said exhaust path including a tailpipe connected to the muffler and an exhaust pipe for releasing exhaust gas, which has been discharged from the tailpipe, to the outer side of the revolving upperstructure, and said counterweight being utilized for the formation of the exhaust path, wherein:

the exhaust path comprises a passage formed through an upper part of the counterweight and accommodating an upper end portion of the tailpipe inserted at least partially into the passage with a predetermined clearance formed around the upper end portion such that the exhaust gas discharged from the tailpipe can be guided to the exhaust pipe.

2. The working machine according to claim 1, wherein:

the passage formed in the counterweight comprises a restricted passage having a diameter dimension that progressively decreases toward an upper end thereof; and the exhaust pipe has a flange at one end face for securing the end face of the exhaust pipe on an upper surface of the counterweight such that the restricted passage is maintained in communication with the exhaust pipe.

3. The working machine according to claim 2, wherein:

the tailpipe comprises a straight pipe extending in a vertical direction; and the restricted passage has a vertical cross-section in a trapezoidal shape formed by vertically cutting a truncated circular cone.

4. The working machine according to claim 2, wherein:

the tailpipe comprises a vertical section connected to the muffler and extending in a vertical direction, and an inclined section arranged in conjunction with the vertical section, progressively extending rearward toward an upper end thereof and having an upper end portion inserted in the restricted passage formed in the counterweight; and the restricted passage comprises an inclined path having an inclination such that the restricted passage progressively extends rearward toward an upper end thereof.

5. The working machine according to claim 1, wherein:

the working machine is further provided with an exhaust-pipe holding member fixed on the counterweight and holding the exhaust pipe in place;

the passage formed in the counterweight comprises an exhaust passage set at a same diameter dimension over an entire length thereof;

the exhaust-pipe holding member is provided with a restricted passage communicating to the exhaust passage and having a diameter dimension that progressively decreases toward an upper end thereof; and the exhaust pipe has a flange for securing the exhaust pipe on an upper surface of the exhaust-pipe holding member such that the restricted passage of the exhaust-pipe holding member is maintained in communication with the exhaust pipe.

6. The working machine according to claim 1, wherein:

the passage formed in the counterweight comprises an exhaust passage set at a same diameter dimension over an entire length thereof.

7. A working machine provided with a revolving upperstructure, working equipment attached to the revolving upperstructure, an engine compartment arranged on the revolving upperstructure, a counterweight disposed behind the engine compartment, a muffler for silencing exhaust gas discharged from an engine accommodated in the engine compartment, and an exhaust path for releasing exhaust gas, which has been discharged from the muffler, to an outer side of the revolving upperstructure, said exhaust path including a tailpipe connected to the muffler and an exhaust pipe for releasing exhaust gas, which has been discharged from the tailpipe, to the outer side of the revolving upperstructure, and said counterweight being utilized for the formation of the exhaust path, wherein:

the exhaust path comprises a passage formed through the counterweight and accommodating an upper end portion of the tailpipe inserted therein with a predetermined clearance formed around the upper end portion such that the exhaust gas discharged from the tailpipe can be guided to the exhaust pipe;

the working machine is further provided with an exhaust-pipe holding member fixed on the counterweight and holding the exhaust pipe in place;

the passage formed through the counterweight comprises an exhaust passage set at a same diameter dimension over an entire length thereof;

the exhaust-pipe holding member is provided with a restricted passage communicating to the exhaust passage and having a diameter dimension that progressively decreases toward an upper end thereof;

the exhaust pipe has a flange for securing the exhaust pipe on an upper surface of the exhaust-pipe holding member such that the restricted passage of the exhaust-pipe holding member is maintained in communication with the exhaust pipe.

8. The working machine according to claim 7, wherein:

the tailpipe comprises a vertical section connected to the muffler and extending in a vertical direction, and an inclined section arranged in conjunction with the vertical section, progressively extending rearward toward an upper end thereof and having an upper end portion inserted in the restricted passage formed in the counterweight; and the restricted passage comprises an inclined path having an inclination such that the restricted passage progressively extends rearward toward an upper end thereof.

9. A working machine provided with a revolving upperstructure, working equipment attached to the revolving upperstructure, an engine compartment arranged on the revolving upperstructure, a counterweight disposed behind the engine compartment, a muffler for silencing exhaust gas discharged from an engine accommodated in the engine compartment, and an exhaust path for releasing exhaust gas, which has been discharged from the muffler, to an outer side of the revolving upperstructure, said exhaust path including a tailpipe connected to the muffler and an exhaust pipe for releasing exhaust gas, which has been discharged from the tailpipe, to the outer side of the revolving upperstructure, and said counterweight being utilized for the formation of the exhaust path, wherein:

the exhaust path comprises a passage formed through the counterweight and accommodating an upper end portion of the tailpipe inserted therein with a predetermined clearance formed around the upper end portion such that the exhaust gas discharged from the tailpipe can be guided to the exhaust pipe, wherein:

the exhaust pipe has a flange for securing the exhaust pipe on an upper surface of the counterweight and the passage is a restricted passage that is maintained in communication with the exhaust pipe.

10. The working machine according to claim 9, wherein:

the restricted passage has a diameter dimension that progressively decreases toward an upper end thereof.

11. The working machine according to claim 9, wherein:

the tailpipe comprises a straight pipe extending in a vertical direction; and the restricted passage has a vertical cross-section in a trapezoidal shape formed by vertically cutting a truncated circular cone.

12. The working machine according to claim 9, wherein:

the tailpipe comprises a vertical section connected to the muffler and extending in a vertical direction, and an inclined section arranged in conjunction with the vertical section, progressively extending rearward toward an upper end thereof and having an upper end portion inserted in the restricted passage formed in the counterweight; and the restricted passage comprises an inclined path having an inclination such that the restricted passage progressively extends rearward toward an upper end thereof.

* * * * *